US008944031B2

(12) United States Patent
Kweon et al.

(10) Patent No.: US 8,944,031 B2
(45) Date of Patent: Feb. 3, 2015

(54) MOUNTING STRUCTURE FOR A DIRECT INJECTION FUEL RAIL

(75) Inventors: Myeong-Hun Kweon, Suwon-si (KR); Sung-Hyun Yoon, Gwangmyeong-si (KR); Sang-Hoon Jeon, Ansan-si (KR)

(73) Assignee: Kefico Corporation, Gunpo-Si, Gyeonggi-Do (KR)

( * ) Notice: Subject to any disclaimer, the term of this patent is extended or adjusted under 35 U.S.C. 154(b) by 347 days.

(21) Appl. No.: 13/390,078

(22) PCT Filed: Jul. 29, 2010

(86) PCT No.: PCT/KR2010/005005

§ 371 (c)(1),
(2), (4) Date: Feb. 10, 2012

(87) PCT Pub. No.: WO2011/019150

PCT Pub. Date: Feb. 17, 2011

(65) Prior Publication Data

US 2012/0138020 A1 Jun. 7, 2012

(30) Foreign Application Priority Data

Aug. 11, 2009 (KR) ..... 10-2009-0073688

(51) Int. Cl.
*F02M 55/02* (2006.01)
*F02M 61/14* (2006.01)

(52) U.S. Cl.
CPC ..... *F02M 55/025* (2013.01); *F02M 61/14* (2013.01); *F02M 2200/03* (2013.01); *F02M 2200/8084* (2013.01); *F02M 2200/856* (2013.01); *F02M 2200/857* (2013.01)
USPC ..... 123/469; 123/456

(58) Field of Classification Search
CPC ..... F02M 55/005; F02M 55/025; F02M 63/0225; F02M 69/465
USPC ..... 123/456, 468–470; 285/148.19, 80, 285/205, 369–371; 228/262.21
See application file for complete search history.

(56) References Cited

U.S. PATENT DOCUMENTS 5,970,953 A * 10/1999 Lorraine et al. ..... 123/470
6,837,228 B2 * 1/2005 Baasch et al. ..... 123/585

(Continued)

FOREIGN PATENT DOCUMENTS

JP 2003-239824 A 8/2003
JP 2005-147075 A 6/2005

(Continued)

OTHER PUBLICATIONS

International Search Report dated Apr. 1, 2011 of PCT/KR2010/005005 which is the parent application—2 pages.

*Primary Examiner* — John Kwon
*Assistant Examiner* — Johnny H Hoang
(74) *Attorney, Agent, or Firm* — Knobbe Martens Olson & Bear LLP

(57) ABSTRACT

The present invention relates to a mounting structure for a direct injection fuel rail. Specifically, a mounting structure 120 for a direct injection fuel rail comprises a mount unit 124 and an injector cup 122 combined with a main pipe 110, wherein the injector cup 122 and the mount unit 124 are connected to and integrated with each other via a bridge 126, wherein the injector cup 122 is bonded to the main pipe 110, and wherein the mount unit 124 is separated from the main pipe 110. As such, concentration of stress due to displacement may be prevented, resistance against fatigue fracture may be increased, thermal deformation and additional concentration of stress may be prevented, manufacturability may be improved, and precise assembling positions may be easily ensured.

6 Claims, 16 Drawing Sheets

(56) References Cited

U.S. PATENT DOCUMENTS

| | | | | |
|---|---|---|---|---|
| 2003/0062428 | A1* | 4/2003 | Baasch et al. | 239/407 |
| 2004/0025832 | A1* | 2/2004 | Baasch et al. | 123/304 |
| 2004/0139950 | A1* | 7/2004 | Flynn et al. | 123/585 |
| 2005/0045155 | A1* | 3/2005 | Harvey et al. | 123/470 |
| 2005/0236060 | A1* | 10/2005 | Matsubara | 138/143 |
| 2006/0118091 | A1* | 6/2006 | Zdroik | 123/470 |
| 2006/0163243 | A1* | 7/2006 | Stieler et al. | 219/607 |
| 2007/0295309 | A1* | 12/2007 | Zdroik et al. | 123/470 |
| 2009/0145504 | A1* | 6/2009 | Colletti et al. | 138/89 |
| 2010/0012093 | A1* | 1/2010 | Pepperine et al. | 123/470 |
| 2010/0031927 | A1* | 2/2010 | Notaro et al. | 123/470 |
| 2011/0108005 | A1* | 5/2011 | Nishizawa et al. | 123/469 |

FOREIGN PATENT DOCUMENTS

| | | | |
|---|---|---|---|
| JP | 2006-046138 | A | 2/2006 |
| JP | 2007-092529 | A | 4/2007 |
| KR | 20-1995-0001989 | Y1 | 3/1995 |

* cited by examiner

MOUNTING STRUCTURE FOR A DIRECT INJECTION FUEL RAIL

TECHNICAL FIELD

The present invention relates to a mounting structure for a direct injection (gasoline direct injection, GDI) fuel rail.

BACKGROUND ART

Currently, various technologies are developed and applied to satisfy globally tightened exhaust gas regulations. In particular, research is being actively conducted on a gasoline direct injection (GDI) engine for directly injecting a high-pressure fuel into a combustion chamber so as to increase combustion efficiency, to reduce an exhaust gas, and to improve fuel efficiency and an output.

A high-pressure pump and a direct injector for injecting a high-pressure fuel are already developed by a plurality of well-known companies, and a fuel rail for stably supplying a fuel into the direct injector (GDI) is being individually developed according to the position and space of an engine.

In a multi port injection (MPI) or port fuel injection (PFI) engine for injecting a fuel into an intake port or valve, combining the fuel with fresh air, and supplying a mixed gas into a combustion chamber, since a low fuel pressure, e.g., 3 to 5 bar, is applied to a fuel rail, development of fuel rails is more focused to ensure reliability regarding vibration and fuel pulsation in a fuel rail rather than to ensure rigidity against a fuel pressure. However, in order to develop GDI fuel rails having a high fuel pressure, e.g., 120 to 200 bar, resistance against fatigue fracture generated due to pressure, vibration, and heat has to be ensured first.

In a conventional GDI fuel rail, a mount unit and an injector cup are independently formed and are individually bonded to a main pipe by using a brazing method (using a filler metal).

However, in that case, due to pressure, vibration, or heat generated by an engine, a fuel rail is displaced and thus a fatigue stress is applied to each component of the fuel rail. In particular, stress is concentrated on brazed parts of a mount unit and an injector cup fixed to an engine head.

DETAILED DESCRIPTION OF THE INVENTION

Technical Problem

The present invention provides a mounting structure for a direct injection fuel rail, capable of dispersing an impact applied to an injector cup due to a repulsive force when a fuel is injected, to a mount unit via a bridge as well as the fuel rail, or via only the bridge not the fuel rail, so as to prevent concentration of stress on a fuel rail due to displacement, to increase resistance against fatigue fracture, to prevent thermal deformation of the fuel rail and additional concentration of stress due to the thermal deformation, to improve manufacturability, and to easily ensure precise assembling positions.

Technical Solution

According to an aspect of the present invention, there is provided a mounting structure for a direct injection fuel rail, the mounting structure comprising a mount unit for supporting a main pipe; and an injector cup combined with the main pipe, wherein the injector cup is bonded to the main pipe and is connected to and integrated with the mount unit via a bridge.

The mount unit may be bonded to the main pipe.

The mount unit may be separated from the main pipe.

The mount unit may be a mounting boss combined with a fixing member, and may have a recessed surface formed in an outer surface of the mount unit so as not to contact an outer surface of the main pipe.

The bridge may have a rectangular cross section vertically extending along an axis of the mount unit or the injector cup.

The bridge may have an I-shaped cross section vertically extending along an axis of the mount unit or the injector cup.

BEST MODE

Hereinafter, the present invention will be described in detail by explaining embodiments of the invention with reference to the attached drawings.

Figure 1:
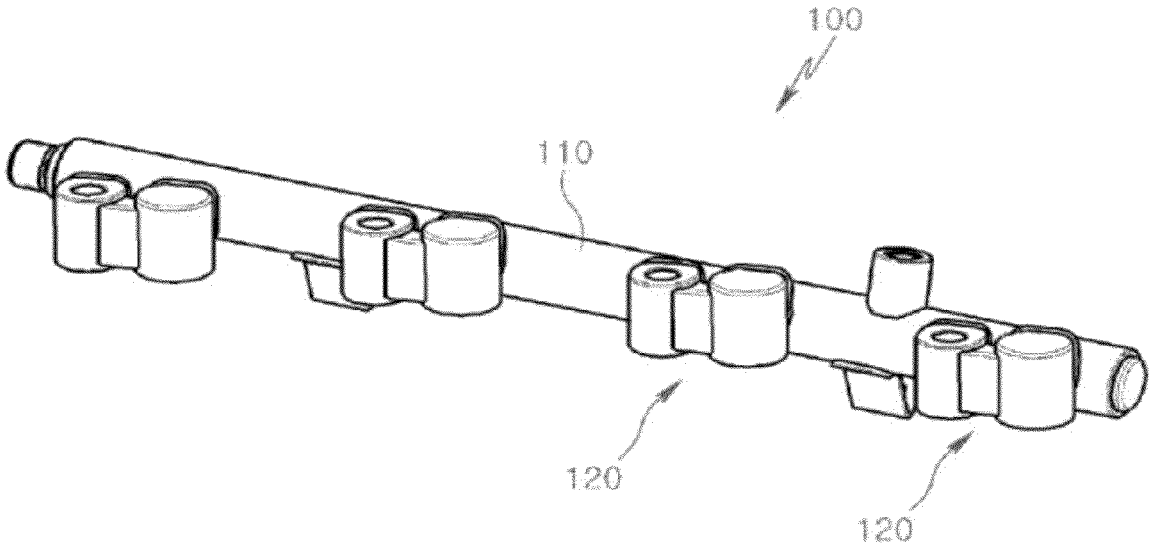
FIG. 1 is a perspective view of a direct injection fuel rail to which a first embodiment of the present invention is applied.
Figure 2:
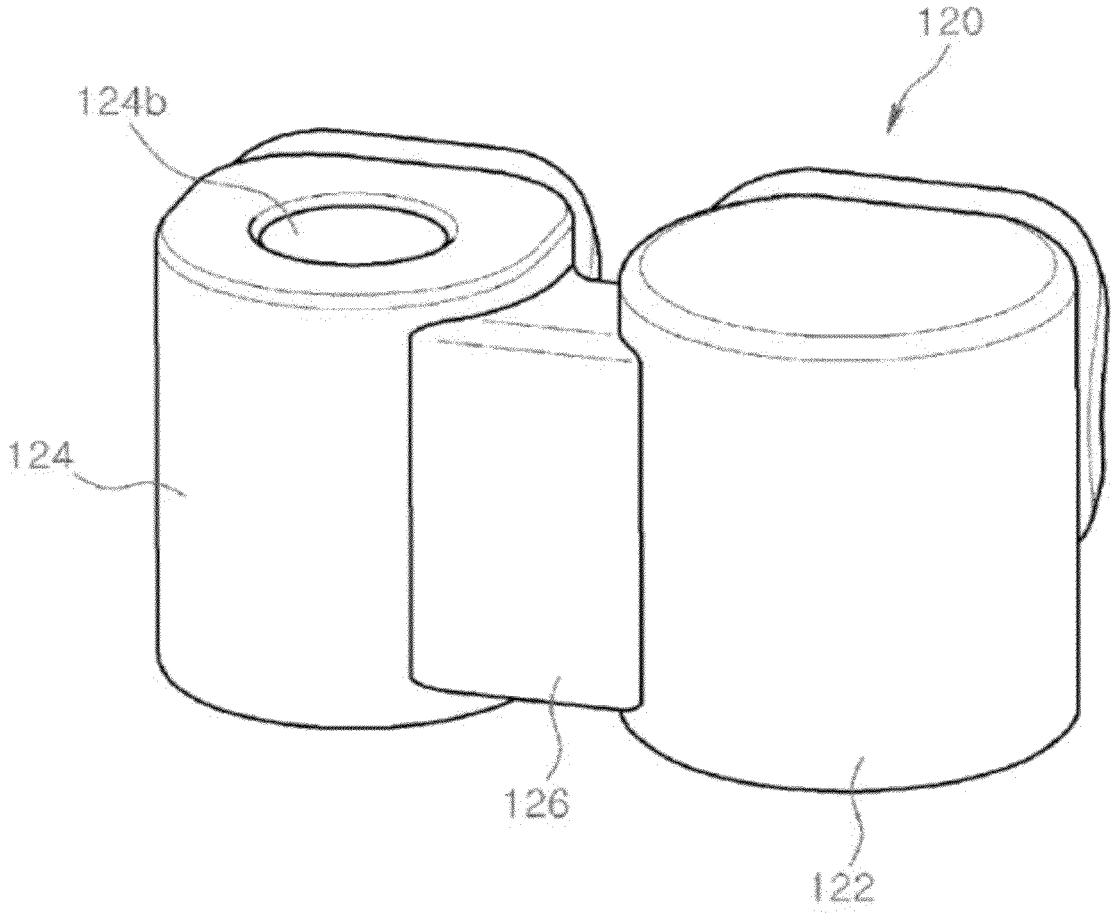
FIG. 2 is a perspective view of a mounting structure illustrated in FIG. 1 before it is bonded to the fuel rail.
Figure 3:
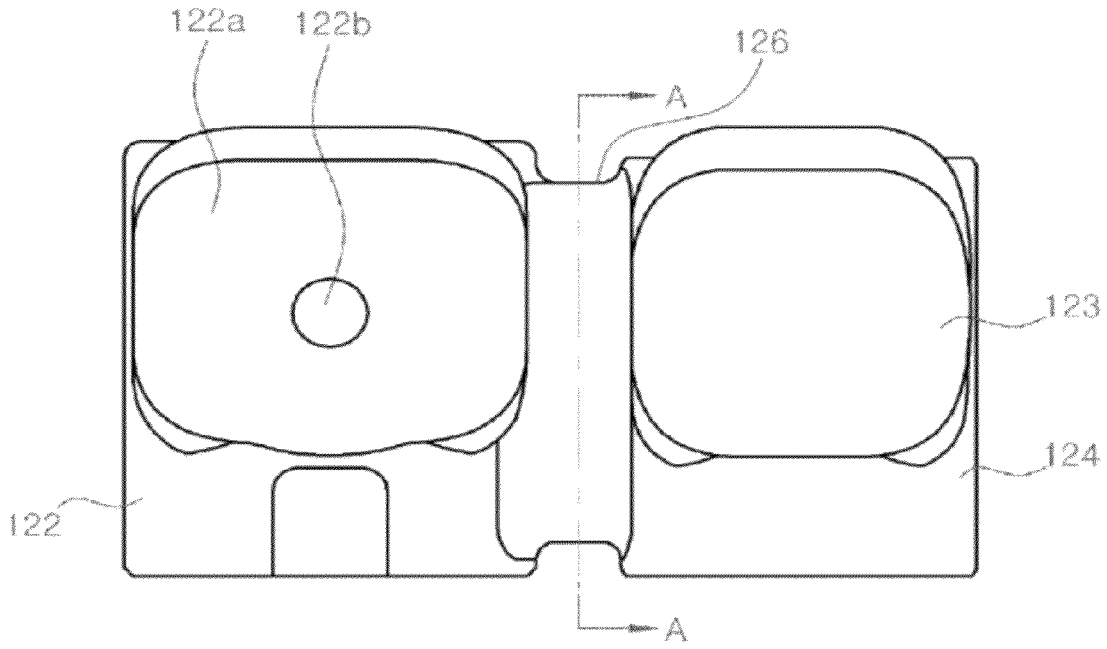
FIG. 3 is a side view of the mounting structure illustrated in FIG. 2 toward the fuel rail.
Figure 4:
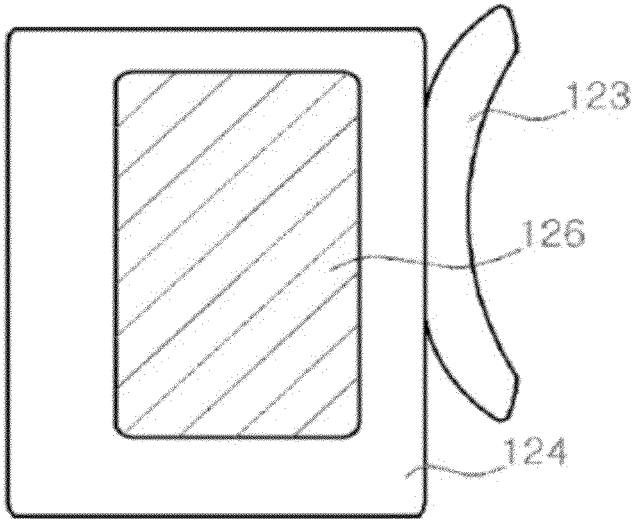
FIG. 4 is a cross-sectional view cut along a line A-A illustrated in FIG. 3.

FIG. 1 is a perspective view of a direct injection fuel rail to which a first embodiment of the present invention is applied. FIG. 2 is a perspective view of a mounting structure illustrated in FIG. 1 before it is bonded to the fuel rail. FIG. 3 is a side view of the mounting structure illustrated in FIG. 2 toward the fuel rail. FIG. 4 is a cross-sectional view of a bridge cut along a line A-A illustrated in FIG. 3.

As illustrated in FIGS. 1 through 4, the fuel rail 100 to which the first embodiment is applied has a configuration in which a plurality of mounting structures 120 each including an injector cup 122 are bonded to a main pipe 110 by using a welding (brazing) method. Here, the brazing method refers to a bonding method using a filler metal such as a non-ferrous metal or its alloy having a melting point lower than that of a base metal and for melting only the filler metal without melting the base metal.

The mounting structure 120 comprises the injector cup 122 and a mount unit 124 connected to the fuel rail 100, and may be integrally processed or casted as one component or may be formed by welding (brazing) the injector cup 122 and the mount unit 124 to each other via the bridge 126.

The injector cup 122 is a part communicating with the main pipe 110 and for injecting a fuel, and includes a bonding surface 122*a* closely coupled to an outer circumferential surface of the main pipe 110, and a hole 122*b* communicating with the main pipe 110.

The mount unit 124 is a mounting boss combined with a fixing member (not shown). Since the main pipe 110 is brazed to an outer surface of the mounting boss, a bonding surface 123 is formed on the outer surface of the mount unit 124 contacting the main pipe 110, and a hole 124*b* into which the fixing member is inserted is formed along a length direction of the mounting boss.

Also, the injector cup 122 has the bonding surface 122*a* brazed to the main pipe 110, and is connected to and integrated with the mounting structure 123 via the bridge 126.

In this case, as illustrated in FIG. 4, the bridge 126 may have a rectangular cross section vertically extending along an axis of the mount unit 124 or the injector cup 122 in order to relatively increase a resistance strength per unit cross-sectional area against a bending force from the injector cup 122 due to a repulsive force when a fuel is injected.

Figure 5:
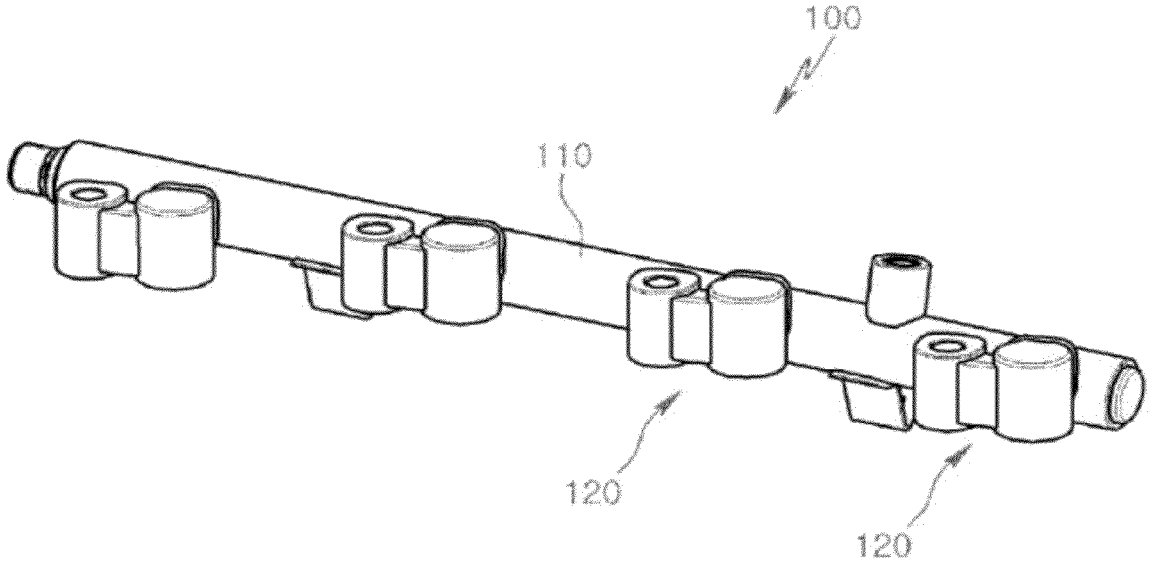
FIG. 5 is a perspective view of a direct injection fuel rail to which a second embodiment of the present invention is applied.
Figure 6:
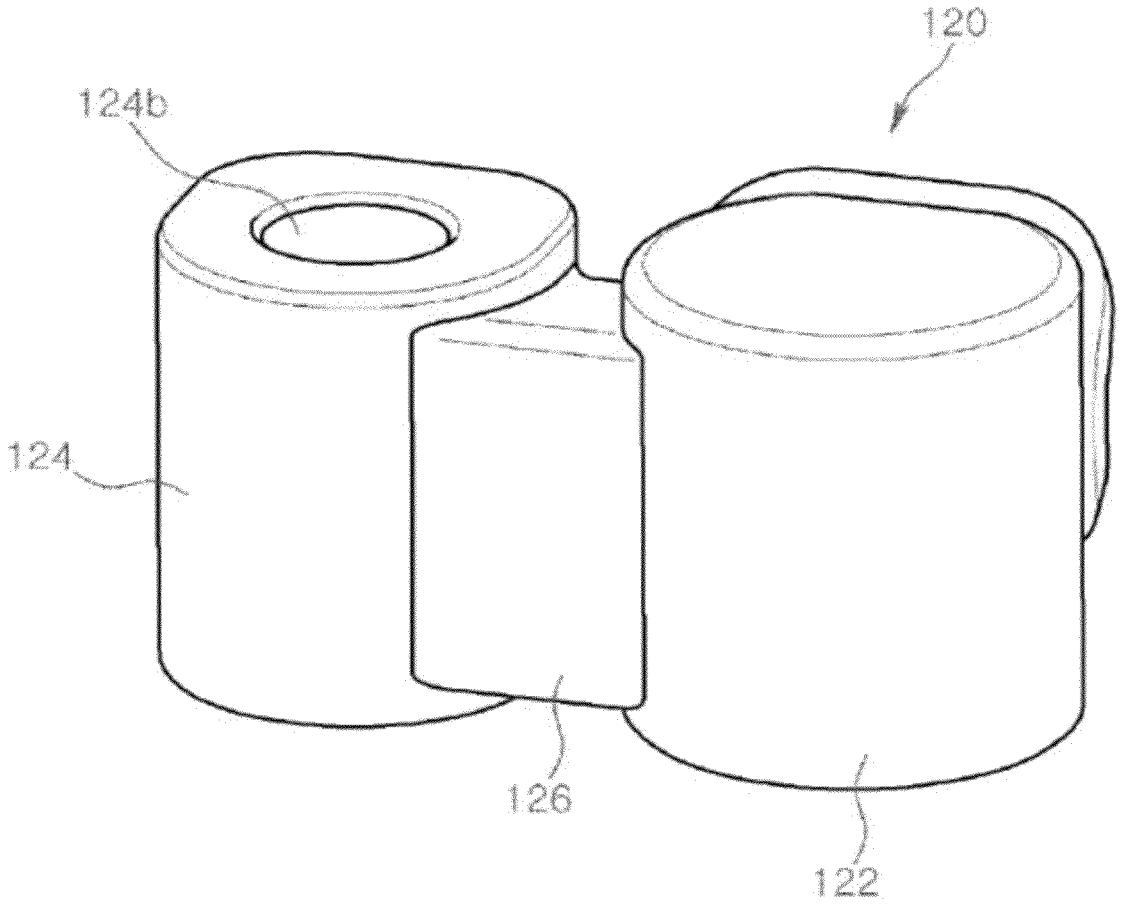
FIG. 6 is a perspective view of a mounting structure illustrated in FIG. 5 before it is bonded to the fuel rail.
Figure 7:
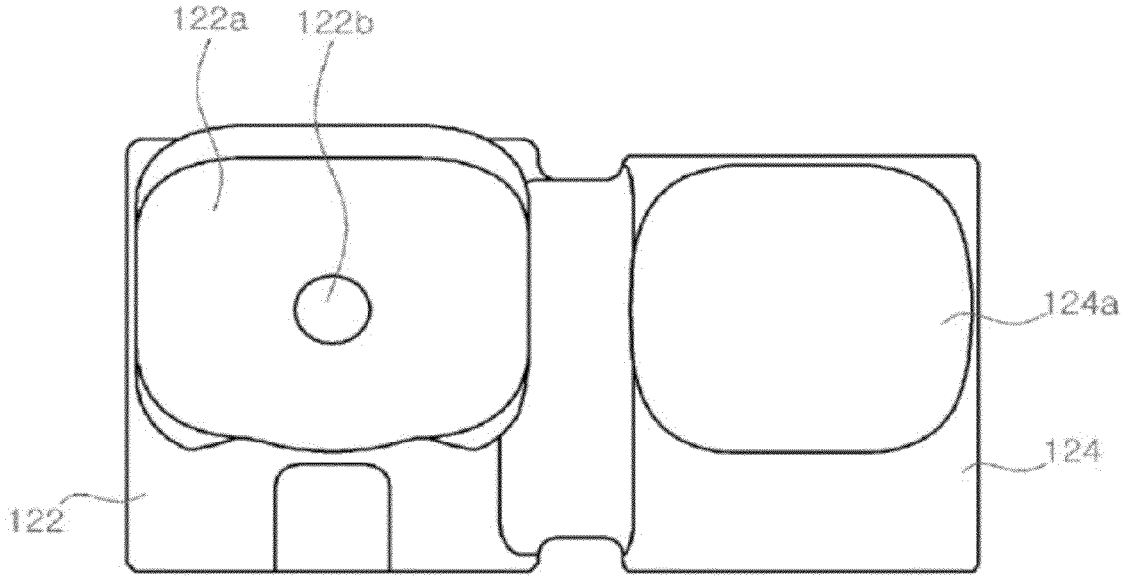
FIG. 7 is a side view of the mounting structure illustrated in FIG. 6 toward the fuel rail.

FIG. 5 is a perspective view of a direct injection fuel rail to which a second embodiment of the present invention is applied. FIG. 6 is a perspective view of a mounting structure illustrated in FIG. 5 before it is bonded to the fuel rail. FIG. 7 is a side view of the mounting structure illustrated in FIG. 6 toward the fuel rail.

As illustrated in FIGS. 5 through 7, as in the first embodiment, the fuel rail 100 to which the second embodiment is applied has a configuration in which a plurality of mounting structures 120 each including an injector cup 122 are bonded to a main pipe 110 by using a welding (brazing) method. The injector cup 122 is the same as that of the first embodiment and thus is not described in detail here.

However, a mount unit 124 is a mounting boss combined with a fixing member (not shown) and has a recessed surface 124*a* formed in an outer surface of the mount unit 124 so as not to contact an outer surface of the main pipe 110. Accordingly, the mount unit 124 is separated from the main pipe 110 by a predetermined distance and is connected to and integrated with the main pipe 110 via a bridge 126.

Figure 8:
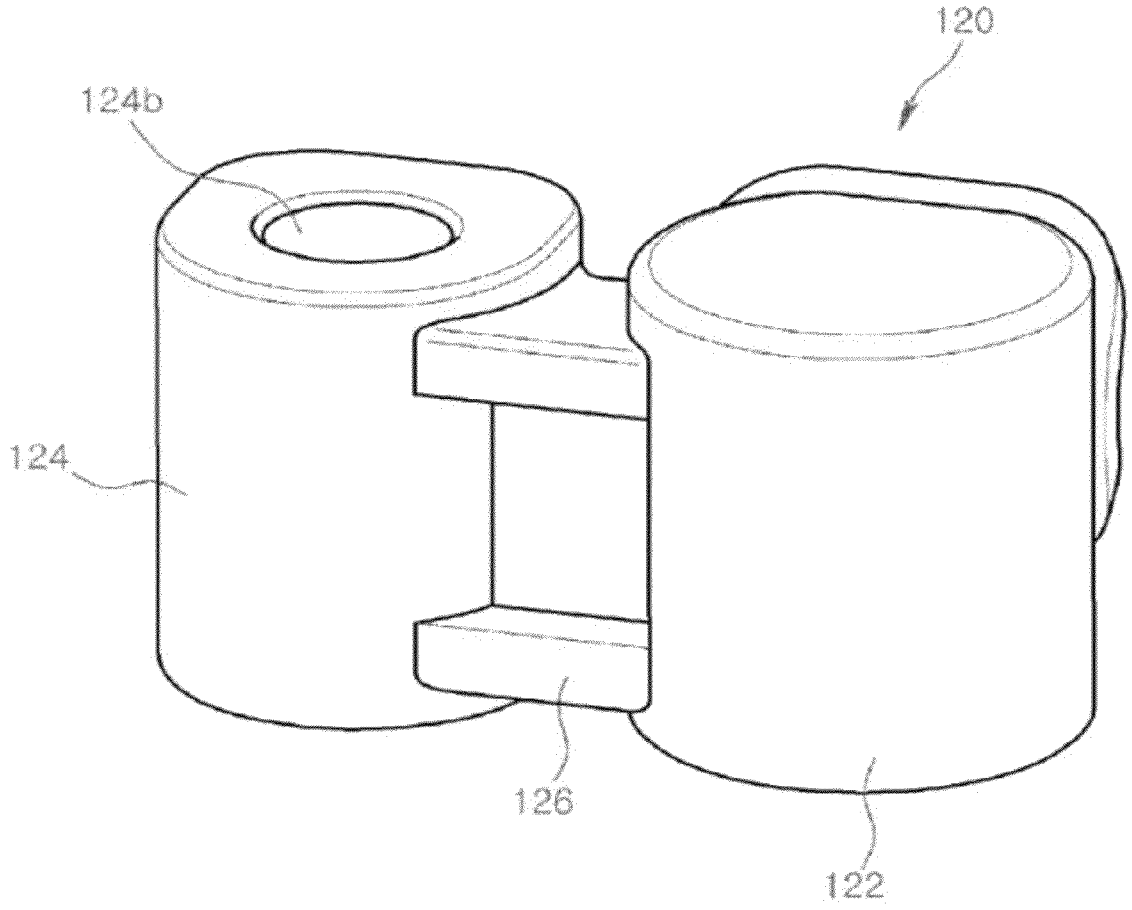
FIG. 8 is a perspective view of a mounting structure according to a third embodiment of the present invention, before it is bonded to a fuel rail.
Figure 9:
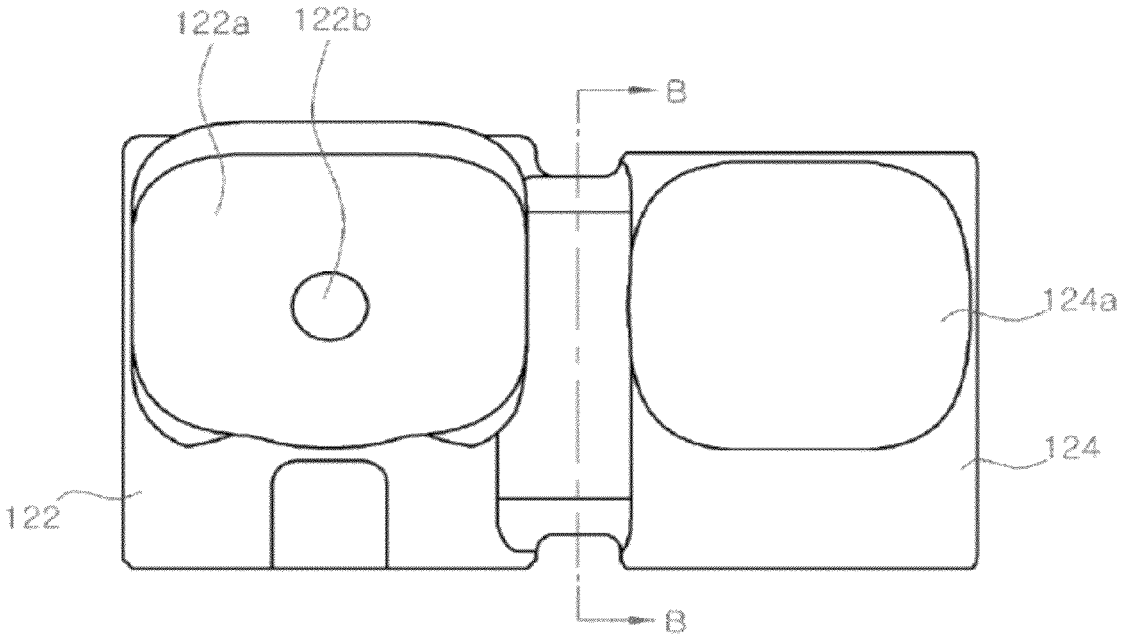
FIG. 9 is a side view of the mounting structure illustrated in FIG. 8 toward the fuel rail.
Figure 10:
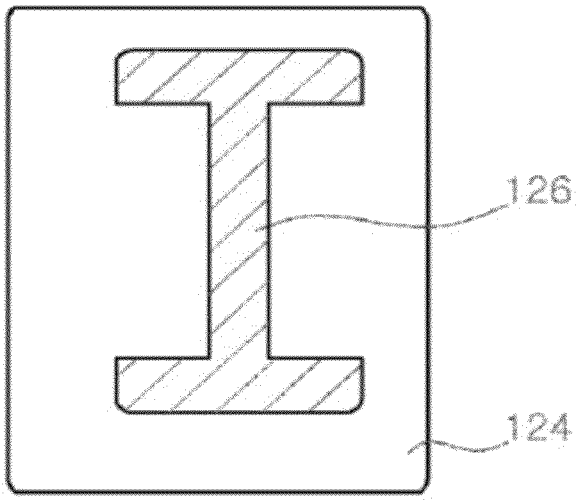
FIG. 10 is a cross-sectional view cut along a line B-B illustrated in FIG. 9.

FIG. 8 is a perspective view of a mounting structure according to a third embodiment of the present invention, before it is bonded to a fuel rail. FIG. 9 is a side view of the mounting structure illustrated in FIG. 8 toward the fuel rail. FIG. 10 is a cross-sectional view cut along a line B-B illustrated in FIG. 9.

As illustrated in FIGS. 8 through 10, the mounting structure 120 according to the third embodiment is the same as that of the second embodiment except that a bridge 126 for connecting a mount unit 124 and an injector cup 122 has an I-shaped cross section vertically extending along an axis of the mount unit 124 or the injector cup 122, and thus other elements having like reference numerals are not described in detail here.

However, due to the I-shaped cross section, the mounting structure 120 of the third embodiment may have a maximum flexural strength per unit cross-sectional area against a bending force from the injector cup 122.

The above-described mounting structure 120 according to the present invention may prevent concentration of stress on a brazed part for fixing the mount unit 124 and the injector cup 122, may prevent deformation of the bridge 126 for connecting the injector cup 122 displaced due to the pressure of a fuel in the fuel rail 100 and the mount unit 124 connected to a fixing part of an engine head, may allow the mount unit 124 and the injector cup 122 to be integrally processed or casted, and may the injector cup 122 and the mount unit 124, or only the non-brazed (non-welded) mount unit 124 to absorb displacement generated due to pressure and heat by brazing (welding) the injector cup 122 to the main pipe 110 and brazing (welding) or separating the mount unit 124 to or from the main pipe 110, thereby ensuring resistance against fatigue fracture and improving manufacturability.

FIGS. 11A through 11C, and 12A through 12C are diagrams showing stresses in a finite element method (FEM) by comparing brazed (welded) parts between embodiments of the present invention and a comparative example.

Figure 11A:
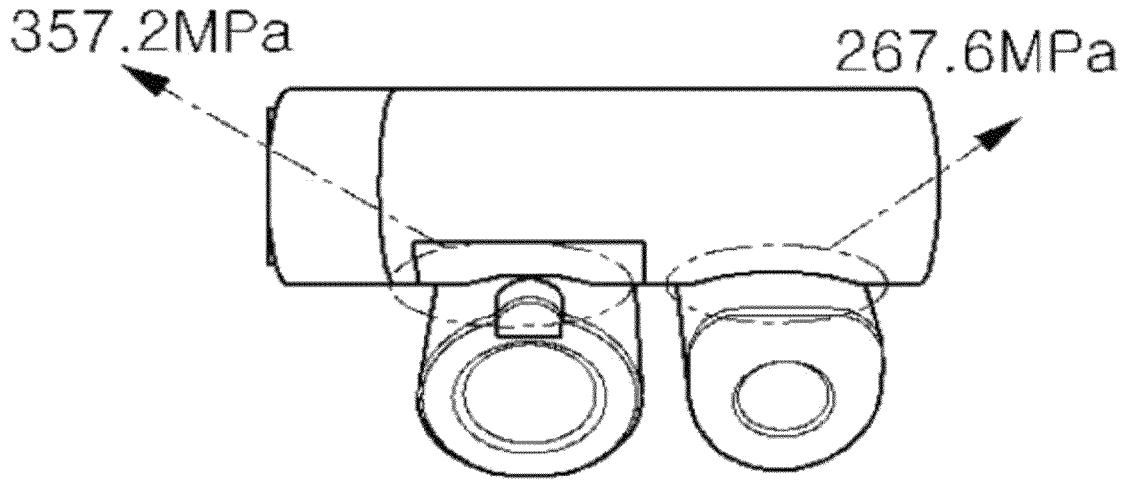
FIGS. 11A through 11C are diagrams for comparing stresses between embodiments of the present invention and a comparative example.
Figure 12A:
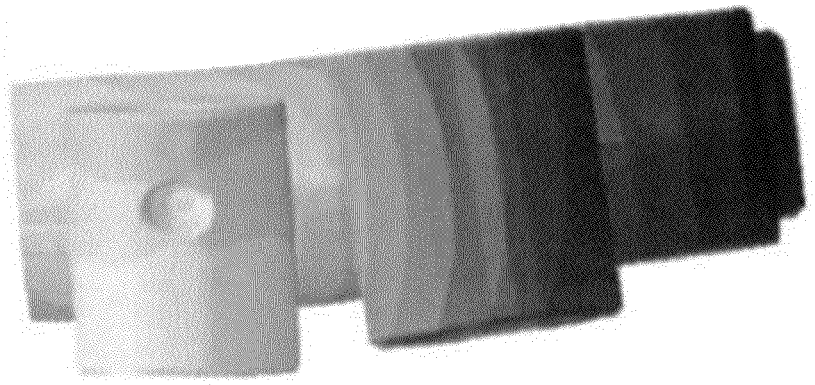
FIGS. 12A through 12C are diagrams showing stress distributions corresponding to FIGS. 11A through 11C.

FIGS. 11A and 12A show the comparative example when an injector cup and a mount unit are separately brazed (welded) to a main pipe. A stress on a bonding part between the injector cup and the main pipe is 357.2 MPa, and a stress on a bonding part between the mount unit and the main pipe is 267.6 MPa.

Figure 11B:
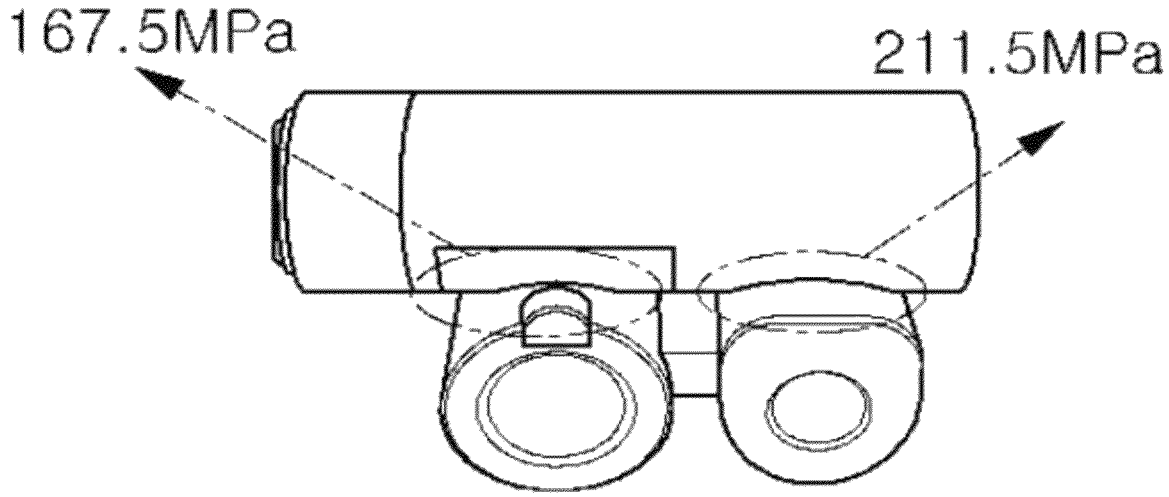
Figure 12B:
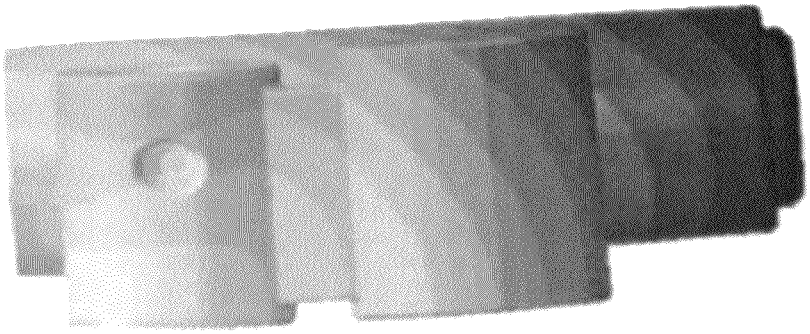

FIGS. 11B and 12B show the first embodiment of the present invention when an injector cup and a mount unit are connected to each other via a bridge, and the injector cup and the mount unit are separately brazed (welded) to a main pipe. A stress on a bonding part between the injector cup and the main pipe is 167.5 MPa, and a stress on a bonding part between the mount unit and the main pipe is 211.5 MPa.

Figure 11C:
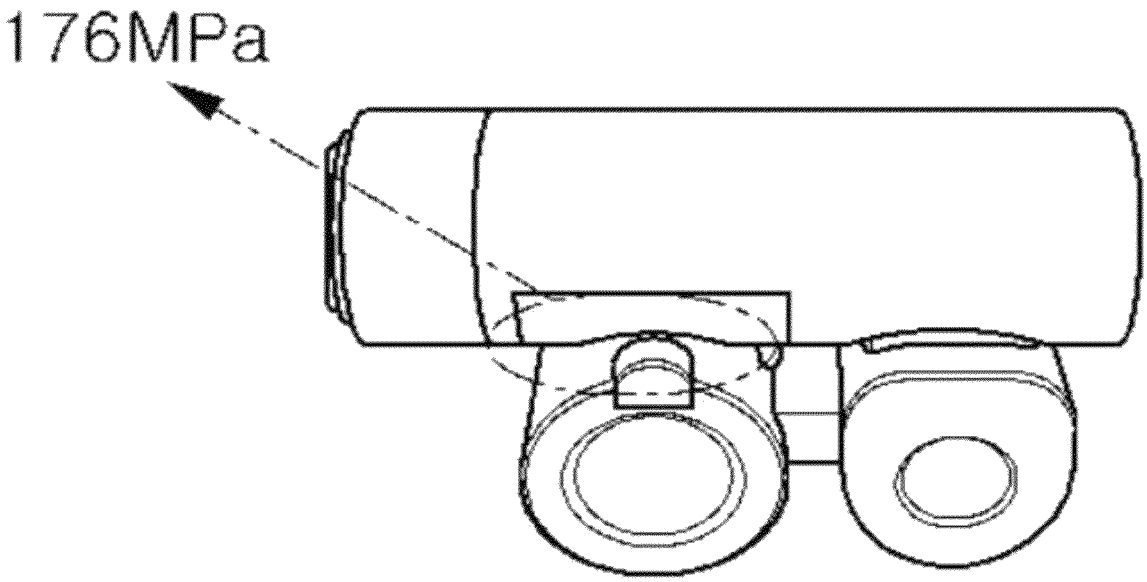
Figure 12C:
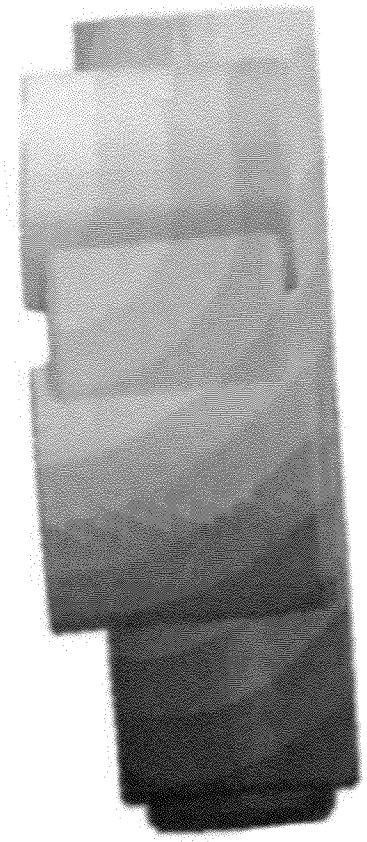

FIGS. 11C and 12C show the second embodiment of the present invention when an injector cup and a mount unit are connected to each other via a bridge, the injector cup is brazed (welded) to a main pipe, and the mount unit is separated form the main pipe. Only a stress on a bonding part between the injector cup and the main pipe is 176 MPa.

As illustrated in FIGS. 11A through 11C, and 12A through 12C, the second embodiment illustrated in FIGS. 11C and 12C may be the most appropriate case in terms of stress and may easily ensure precise assembling positions of the mount unit and the injector cup because a mounting structure is fixed onto the main pipe with reference to the injector cup. Also, the mounting structure of the second embodiment may easily align assembling positions because it is bonded to the main pipe at one position, i.e., the injector cup.

Meanwhile, in the first embodiment illustrated in FIGS. 11B and 12B, although the stress on a bonding part between the injector cup and the main pipe is 167.5 MPa, since a stress of 211.5 MPa occurs on a bonding part between the mount unit and the main pipe and both the injector cup and the mount unit are bonded to the main pipe, precise assembling positions may not be easily ensured.

Industrial Applicability

In a mounting structure for a direct injection fuel rail, according to the present invention, a manufacturing method may be easily selected according to a situation after the mounting structure is processed or casted according to the configuration of the fuel rail, and may easily ensure precise assembling positions of a mount unit and an injector cup because the mounting structure is fixed onto a main pipe with reference to the injector cup. Also, since only the injector cup is brazed, displacement generated due to pressure and heat may be dispersed, concentration of stress may be reduced, and thus resistance against fatigue fracture may be ensured.

The invention claimed is:

1. A mounting structure for a direct injection fuel rail, the mounting structure comprising:

a main pipe of a direct injection fuel rail;

an injector cup comprising a bonding surface for connecting to the main pipe;

the bonding surface configured to correspond to a circumferential surface of the main pipe and bonded to the corresponding circumferential surface, the bonding surface having a through hole for establishing a fluid communication between the injector cup and the main pipe;

a mount unit connected to the injector cup via a bridge such that the mount unit is connected to the main pipe via the bridge and the injector cup while spaced from the main pipe.

2. The mounting structure of claim 1, wherein the mount unit comprises a mounting boss combined with a fixing member, and has a recessed surface formed in an outer surface of the mount unit so as not to contact an outer surface of the main pipe.

3. The mounting structure of claim 1, wherein the bridge has a rectangular cross section vertically extending along an axis of the mount unit or the injector cup.

4. The mounting structure of claim 1, wherein the bridge has an I-shaped cross section vertically extending along an axis of the mount unit or the injector cup.

5. The mounting structure of claim 2, wherein the bridge has a rectangular cross section vertically extending along an axis of the mount unit or the injector cup.

6. The mounting structure of claim 2, wherein the bridge has an I-shaped cross section vertically extending along an axis of the mount unit or the injector cup.

* * * * *